US009052138B2

(12) United States Patent
DeMarco et al.

(10) Patent No.: US 9,052,138 B2
(45) Date of Patent: Jun. 9, 2015

(54) BULK FREEZE DRYING USING SPRAY FREEZING AND STIRRED DRYING

(75) Inventors: Francis W. DeMarco, Niagara Falls, NY (US); Ernesto Renzi, Youngstown, NY (US)

(73) Assignee: IMA LIFE NORTH AMERICA INC., Tonawanda, NY (US)

( * ) Notice: Subject to any disclaimer, the term of this patent is extended or adjusted under 35 U.S.C. 154(b) by 202 days.

(21) Appl. No.: 13/811,937

(22) PCT Filed: Aug. 4, 2010

(86) PCT No.: PCT/US2010/002167
§ 371 (c)(1),
(2), (4) Date: Jan. 24, 2013

(87) PCT Pub. No.: WO2012/018320
PCT Pub. Date: Feb. 9, 2012

(65) Prior Publication Data
US 2013/0118026 A1 May 16, 2013

(51) Int. Cl.
*F26B 5/00* (2006.01)
*F26B 5/06* (2006.01)

(52) U.S. Cl.
CPC ..... *F26B 5/065* (2013.01)

(58) Field of Classification Search
CPC ..... F26B 5/00; F26B 5/06; F26B 13/00; F26B 13/30; A61K 9/00; A61K 9/16; A61K 9/19; A61P 31/00; A61P 31/04
USPC ..... 34/284, 287, 289, 380, 381, 92; 62/64, 62/534, 540; 424/464, 468, 488
See application file for complete search history.

(56) References Cited

U.S. PATENT DOCUMENTS

| | | | | |
|---|---|---|---|---|
| 2,411,152 | A | 11/1946 | Folsom | |
| 2,616,604 | A | 11/1952 | Folsom | |
| 3,266,169 | A | 8/1966 | Smith, Jr. | |
| 3,300,868 | A | 1/1967 | Anderwert | |
| 3,313,032 | A | 4/1967 | Malecki | |
| 3,396,475 | A | 8/1968 | George | |
| 3,673,698 | A * | 7/1972 | Guerard | 34/284 |
| 5,208,998 | A | 5/1993 | Oyler | |
| 5,230,162 | A | 7/1993 | Oyler, Jr. | |
| 5,583,166 | A | 12/1996 | Okamoto et al. | |
| 5,727,333 | A * | 3/1998 | Folan | 34/285 |
| 6,284,282 | B1 | 9/2001 | Maa et al. | |

(Continued)

FOREIGN PATENT DOCUMENTS

| | | | |
|---|---|---|---|
| CN | 201014888 | Y | 1/2008 |
| CN | 101403561 | A | 4/2009 |

(Continued)

OTHER PUBLICATIONS

Hosokawa Micron Powder Systems, "Vrieco-Nauta active Freeze Dryer" (printed from WEB May 25, 2010).

(Continued)

*Primary Examiner* — Stephen M Gravini

(57) ABSTRACT

A freeze dryer processes bulk powder products. The freeze dryer freezes the product by mixing an atomized spray of product with sterile liquid nitrogen. The resultant powder is freeze dried in a vessel, and the vessel contents is agitated to maintain product contact with heated vessel wall and to prevent agglomeration.

30 Claims, 5 Drawing Sheets

(56) References Cited

U.S. PATENT DOCUMENTS

| | | | | |
|---|---|---|---|---|
| 6,695,238 | B2 | 2/2004 | Inoki et al. | |
| 7,363,726 | B2 | 4/2008 | Wang et al. | |
| 8,171,652 | B2 * | 5/2012 | Py | 34/287 |
| 8,322,046 | B2 * | 12/2012 | Wang et al. | 34/286 |
| 8,769,841 | B2 * | 7/2014 | Gruber et al. | 34/287 |
| 2002/0050072 | A1 | 5/2002 | Akimoto et al. | |
| 2003/0014879 | A1 | 1/2003 | Horigane | |
| 2003/0215515 | A1 * | 11/2003 | Truong-Le et al. | 424/489 |
| 2004/0154317 | A1 * | 8/2004 | Shekunov et al. | 62/64 |
| 2005/0160615 | A1 | 7/2005 | Wang et al. | |
| 2005/0178020 | A1 * | 8/2005 | Shekunov et al. | 34/284 |
| 2006/0130355 | A1 | 6/2006 | Wang et al. | |
| 2007/0022622 | A1 | 2/2007 | Lanaway et al. | |
| 2007/0190158 | A1 | 8/2007 | Hwang et al. | |
| 2013/0118026 | A1 * | 5/2013 | DeMarco et al. | 34/284 |
| 2013/0150316 | A1 * | 6/2013 | Jiang et al. | 514/30 |

FOREIGN PATENT DOCUMENTS

| | | | | |
|---|---|---|---|---|
| CN | 101441030 | A | | 5/2009 |
| CN | 101713607 | A | | 5/2010 |
| CN | 101738063 | A | | 6/2010 |
| EP | 1590613 | | * | 4/2014 |
| JP | H10-160338 | | | 6/1998 |
| JP | 2002-325565 | A | | 11/2002 |
| JP | 2004-232883 | A | | 8/2004 |
| JP | 2005-168904 | A | | 6/2005 |
| JP | 2008-507307 | A | | 3/2008 |
| JP | 2010-538236 | A | | 12/2010 |
| WO | 2004073845 | | | 9/2004 |
| WO | WO 2004071410 | A3 | * | 3/2005 |
| WO | 2005105253 | | | 10/2005 |
| WO | WO 2008057383 | A2 | * | 5/2008 |
| WO | 2009029749 | | | 3/2009 |
| WO | WO2010/013583 | A1 | | 4/2010 |
| WO | WO 2010074723 | | * | 7/2010 |

OTHER PUBLICATIONS

Hosokawa Micron B.V., "Stirred Freeze Drying," Hosokawa News, Feb. 2008.

Peter D.J. Van Der Wel, "Simpler, quicker, cheaper, Freeze drying: a new take on old technology," PROCESS Worldwide 46 (Apr. 2008).

The Linde Group, "Linde helps boost quality and performance for biotech customers" (printed from WEB May 25, 2010).

Office Action, Japanese Patent Application No. 2013-216841 (related application) ("Notification of Reason for Refusal") with English Translation and list of citations (Jul. 31, 2014).

Office Action, Chinese Patent Application No. 201080068427.5 (related application) ("Notification of the First Office Action") with English Translation and list of citations (May 6, 2014).

Yang Zhuoru, et al., Freeze Drying and Application thereof, "Guangdong Chemical Industry" Issue No. 3, pp. 11-14, 20 (Sep. 30, 1988).

Li Xianfa, Application and Development of Vacuum Freeze Drying Technology in Preparation of Biological Material, "Journal of Southwestern University of Science and Technology" Volume No. 19, Issue No. 2 pp. 117-121 (Jun. 20, 2004).

Communication from EPO including European Search Report in related case, with list of citations (Jan. 26, 2015).

Communication from EPO including Supplemental European Search Report in related case, with list of citations (Apr. 24, 2015).

* cited by examiner

BULK FREEZE DRYING USING SPRAY FREEZING AND STIRRED DRYING

FIELD OF THE INVENTION

The present invention relates generally to freeze drying processes and equipment for removing moisture from a product using vacuum and low temperature. More specifically, the invention relates to the freeze drying of bulk powder and especially pharmaceutical products and other bulk powder products, including those requiring aseptic handling.

BACKGROUND

Freeze drying is a process that removes a solvent or suspension medium, typically water, from a product. While the present disclosure uses water as the exemplary solvent, other solvents, such as alcohol, may also be removed in freeze drying processes and may be removed with the presently disclosed methods and apparatus.

In a freeze drying process for removing water, the water in the product is frozen to form ice and, under vacuum, the ice is sublimed and the vapor flows towards a condenser. The water vapor is condensed on the condenser as ice and is later removed from the condenser. Freeze drying is particularly useful in the pharmaceutical industry, as the integrity of the product is preserved during the freeze drying process and product stability can be guaranteed over relatively long periods of time. The freeze dried product is ordinarily, but not necessarily, a biological substance.

Pharmaceutical freeze drying is often an aseptic process that requires sterile conditions within the freeze drying chamber. It is critical to assure that all components of the freeze drying system coming into contact with the product are sterile.

Most bulk freeze drying in aseptic conditions is done in a freeze dryer designed for vials, wherein bulk product is placed in trays designed for holding vials. In one example of a prior art freeze drying system 100 shown in FIG. 1, a batch of product 112 is placed in freeze dryer trays 121 within a freeze drying chamber 110. Freeze dryer shelves 123 are used to support the trays 121 and to transfer heat to and from the trays and the product as required by the process. A heat transfer fluid flowing through conduits within the shelves 123 is used to remove or add heat.

Under vacuum, the frozen product 112 is heated slightly to cause sublimation of the ice within the product. Water vapor resulting from the sublimation of the ice flows through a passageway 115 into a condensing chamber 120 containing condensing coils or other surfaces 122 maintained below the condensation temperature of the water vapor. A coolant is passed through the coils 122 to remove heat, causing the water vapor to condense as ice on the coils.

Both the freeze drying chamber 110 and the condensing chamber 120 are maintained under vacuum during the process by a vacuum pump 150 connected to the exhaust of the condensing chamber 120. Non-condensable gases contained in the chambers 110, 120 are removed by the vacuum pump 150 and exhausted at a higher pressure outlet 152.

Tray dryers are designed for aseptic vial drying and are not optimized to handle bulk product. The product must be manually loaded into the trays, freeze dried, and then manually removed from the trays. Handling the trays is difficult, and creates the risk of a liquid spill. Heat transfer resistances between the product and the trays, and between the trays and the shelves, sometimes causes irregular heat transfer. Dried product must be removed from trays after processing, resulting in product handling loss.

Because the process is performed on a large mass of product, agglomeration into a "cake" often occurs, and milling is required to achieve a suitable powder and uniform particle size. Cycle times may be longer than necessary due to resistance of the large mass of product to heating and the poor heat transfer characteristics between the trays, the product and the shelves.

Spray freeze drying has been suggested, wherein a liquid substance is sprayed into a low temperature, low pressure environment, and water in the resulting frozen particles is sublimated by exposing the falling particles to radiant heat (see, e.g., U.S. Pat. No. 3,300,868). That process is limited to materials from which water may be removed rapidly, while the particles are airborne, and requires radiant heaters in a low temperature environment, reducing efficiency.

Spray freezing of a product by atomizing the product together with liquid nitrogen (LN2) or a cold gas has been suggested in conjunction with atmospheric freeze drying using a desiccating gas such as nitrogen. One example is shown in U.S. Pat. No. 7,363,726. Frozen particles are collected in a drying vessel having a bottom with a porous metal filter plate. The desiccating gas is passed through the product, creating a partial pressure of water vapor from the product over the dry desiccating gas, causing sublimation and/or evaporation of the water contained in the product. Such a process is not easily adapted for aseptic processing, because both the cold gas for freezing and the desiccating gas must be sterile. The process may potentially consume large amounts of nitrogen. Atmospheric drying is typically slower than vacuum drying of equivalent powder.

Stirred freeze dryers perform both the freezing step and the vacuum sublimation step under stirred conditions. Heat is introduced through the vessel jacket during the sublimation stage. A stirred freeze dryer has been marketed, for example, by Hosokawa Micron Powder Systems of Summit, N.J.

There is a need for an improved technique for processing bulk quantities of aseptic materials that are not contained in vials. The technique should maintain an aseptic environment for the process, and minimize handling of the product in trays, with the potential of spills. The process should avoid secondary operations such as milling to produce uniform particle sizes. The process should avoid the heat transfer problems associated with drying bulk product on trays. The process should be as continuous as possible, avoiding product transfer between equipment wherever possible.

SUMMARY

The present disclosure addresses the needs described above by providing a freeze drying system for freeze drying bulk product by removing a liquid. The system includes a freeze drying chamber for containing product during the freeze drying process, and at least one bulk product spray nozzle connected to a source of the bulk product. The at least one bulk product spray nozzle is directed to an interior of the freeze drying chamber for spraying the bulk product into the freeze drying chamber.

The system additionally includes at least one aseptic freezing agent spray nozzle connected to a source of a freezing agent. The at least one freezing agent spray nozzle is directed to the interior of the freeze drying chamber for spraying the freezing agent into the freeze drying chamber. The at least one bulk product spray nozzle and the at least one freezing agent spray nozzle are further directed to comingle respective sprays in the interior of the freeze drying chamber to create a spray-frozen product.

The system also includes an agitating mechanism in a lower portion of the freeze drying chamber for agitating spray-frozen product accumulated in the lower portion of the chamber, a heater for heating at least lower walls of the freeze drying chamber, a condensing chamber in communication with the freeze drying chamber and comprising surfaces for condensing a vapor from exhaust gas received from the freezer drying chamber, and a vacuum pump in communication with the condensing chamber.

The system may also include a sterilant introducing means for introducing a sterilant into the freeze drying chamber. The sterilant may be selected from the group consisting of steam and vaporized hydrogen peroxide.

The agitating mechanism may include a rotationally driven agitator to move spray-frozen product particles to the chamber walls for heating. The rotationally driven agitator may be driven by a drive shaft passing through the chamber wall, or may be driven magnetically from outside the chamber wall. The agitating mechanism may alternatively be a vibrating mechanism externally mounted to the chamber wall.

The freezing agent may be sterile liquid nitrogen. A lower portion of the freeze drying chamber may be conical in shape. The heater may be an electrical heater, or may be a jacket for circulating a heated fluid. The heated fluid may be heated at least in part from heat extracted from the freezing agent.

Another freeze drying system for freeze drying bulk product by removing a liquid, comprises a freezing chamber for containing product during the freezing process, and a plurality of spray nozzles configured for comingling sprays of the bulk product and a freezing agent inside the freezing chamber to produce a spray-frozen product powder.

That system also includes a plurality of drying chambers, each drying chamber being connected to the freezing chamber by a respective selectively closeable conduit. Each drying chamber comprises an agitating mechanism in a lower portion of the drying chamber for agitating spray frozen product powder in the lower portion of the chamber, and a heater for heating at least lower walls of the drying chamber.

The system additionally includes at least one condensing chamber, each one of the plurality of drying chambers being in communication with at least one of the condensing chambers, the condensing chambers comprising surfaces for condensing a vapor from exhaust gas received from the drying chambers. A vacuum pump is in selective communication with the drying chambers and the condensing chamber.

The system may additionally include a control means for operating the selectively closeable conduits to direct the spray-frozen product powder into a first chamber of the plurality of drying chambers while simultaneously operating a second chamber of the drying chambers by evacuating the second chamber with the vacuum pump and heating the lower walls of the second chamber with the heater.

A first drying chamber may be in selective communication with first and second condensing chambers, whereby one of the first and second condensing chambers is operated to condense the solvent vapor while condensed solvent is removed from another of the chambers.

The system may include a sterilant introducing means for introducing a sterilant into at least the freezing chamber and the drying chambers. The sterilant may be selected from the group consisting of steam and vaporized hydrogen peroxide. The freezing agent may be sterile liquid nitrogen. Lower portions of the drying chambers may be conical.

Another embodiment of the invention is a method for freeze drying a bulk product containing a liquid. The bulk product is sprayed into a freezing vessel, and a freezing agent is sprayed into the freezing vessel, the freezing agent intermingling with the sprayed bulk product to freeze the liquid contained in the bulk product to form a frozen powder before the product drops to a lower portion of the freezing vessel.

The frozen powder is subjected to vacuum, is agitated and is heated to cause sublimation of frozen liquid in the bulk product to form a freeze dried product. The freeze dried product is then returned to atmospheric pressure.

Subjecting the frozen powder to vacuum, agitating the frozen powder and heating the frozen powder may be performed in the freezing vessel, or my be performed in a drying vessel separate from the freezing vessel.

The method may additionally include transferring a first portion of frozen powder from the freezing vessel to a first drying vessel, performing in the first drying vessel the steps of subjecting the frozen powder to vacuum, stirring the frozen powder and heating the frozen powder, transferring a second portion of frozen powder from the freezing vessel to a second drying vessel, and performing in the second drying vessel the steps of subjecting the frozen powder to vacuum, stirring the frozen powder and heating the frozen powder.

The freezing agent may be sterile liquid nitrogen. The bulk product and the freezing agent may be sprayed from separate nozzles into the freezing vessel. Spraying the bulk product and spraying the freezing agent may be performed concurrently. Heating the frozen powder may include transferring heat from the walls of a vessel.

The method may additionally include condensing vapor from the sublimation of the frozen liquid in a condensing vessel.

DESCRIPTION

Figure 1:
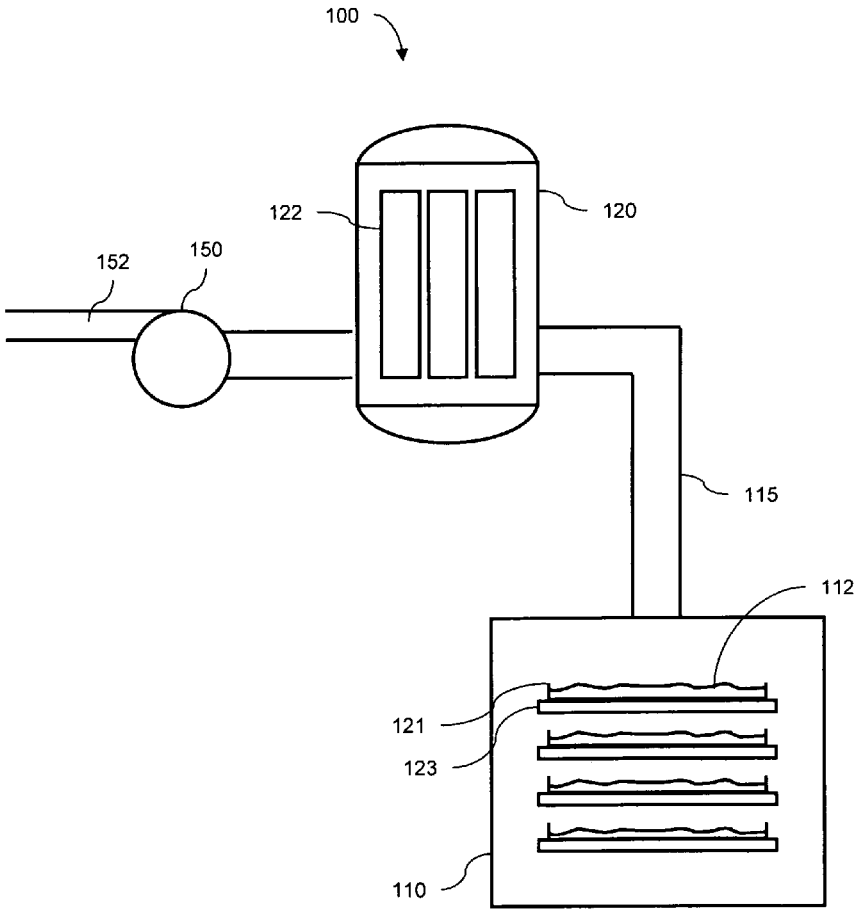
Fig. 1 (prior art)
FIG. 1 is a schematic drawing of a prior art freeze drying system.

The present disclosure describes systems and methods for freeze drying bulk materials in an efficient manner. In cases where aseptic bulk materials are processed, those materials may be processed without compromising the aseptic qualities of the product. More specifically, the systems and methods of the present disclosure are directed to a bulk powder freeze dryer which is optimized to freeze and dry product in the powder form.

The processes and apparatus may advantageously be used in drying pharmaceutical products that require aseptic or sterile processing, such as injectables. The methods and apparatus may also be used, however, in processing materials that do not require aseptic processing, but require moisture removal while preserving structure, and require that the resulting dried product be in powder form. For example, ceramic/metallic products used as superconductors or for forming nanoparticles or microcircuit heat sinks may be produced using the disclosed techniques.

The systems and methods described herein may be performed in part by an industrial controller and/or computer used in conjunction with the processing equipment described below. The equipment is controlled by a plant logic controller (PLC) that has operating logic for valves, motors, etc. An interface with the PLC is provided via a PC. The PC loads a user-defined recipe or program to the PLC to run. The PLC will upload to the PC historical data from the run for storage. The PC may also be use for manually controlling the devices, operating specific steps such as freezing, defrost, steam in place, etc.

The PLC and the PC include central processing units (CPU) and memory, as well as input/output interfaces connected to the CPU via a bus. The PLC is connected to the processing equipment via the input/output interfaces to receive data from sensors monitoring various conditions of the equipment such as temperature, position, speed, flow, etc. The PLC is also connected to operate devices that are part of the equipment.

The memory may include random access memory (RAM) and read-only memory (ROM). The memory may also include removable media such as a disk drive, tape drive, etc., or a combination thereof. The RAM may function as a data memory that stores data used during execution of programs in the CPU, and is used as a work area. The ROM may function as a program memory for storing a program including the steps executed in the CPU. The program may reside on the ROM, and may be stored on the removable media or on any other non-volatile computer-usable medium in the PLC or the PC, as computer readable instructions stored thereon for execution by the CPU or other processor to perform the methods disclosed herein.

The presently described methods and apparatus utilize spray freezing by combining the atomized liquid product (through spray nozzles) with atomized liquid nitrogen (LN2). In cases where the presently described systems and methods are used in the processing of products requiring sterile or aseptic processing, sterile LN2 is used. One technique for the production of sterile liquid nitrogen is described in PCT International Publication No. WO 2009/029749A1, assigned to Linde, Inc. of Murray Hill, N.J., USA.

Figure 2:
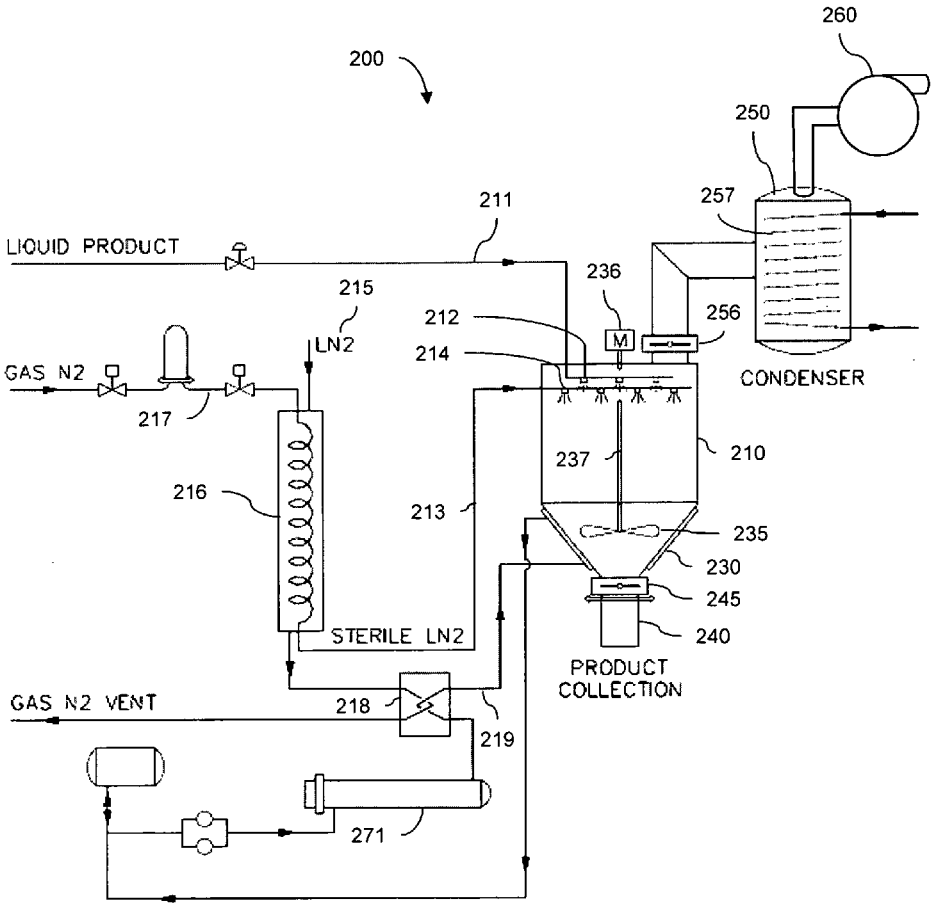
FIG. 2 is a schematic drawing of a freeze drying system according to one embodiment of the disclosure.

An exemplary system 200 in accordance with one disclosed embodiment is shown in FIG. 2. Spray nozzles 212 are connected to a source 211 of liquid product. The nozzles are arranged to atomize the product within a freeze drying vessel 210. The liquid product may be a solution or a suspension of a biological solid in water or another liquid. The atomization of the product results in a dispersion of fine particles within the freeze drying vessel 210.

Both the size of the particles and the distribution of particle sizes are dependent on the spraying technology. For example, nozzle geometry, product flow rate and nozzle placement within the chamber may influence those process outputs. Particle size and size distribution are important to the application of the product. For example, for powder handling, it is preferable to have particle sizes above 100 microns, while for pulmonary applications, particle size should be around 6 microns.

Another set of spray nozzles 214 is arranged to comingle a spray of an aseptic freezing agent such as sterile LN2 with the atomized liquid product. The atomized liquid product freezes as the sterile LN2 vaporizes and absorbs heat from the liquid product within the freeze drying vessel 210. The spray nozzles 214 are connected to a source 213 of the aseptic freezing agent. In the example shown, sterilized LN2 is used. The use of sterile LN2 as the cold source makes possible the direct contact of aseptic atomized product with the cold source or freezing agent, without contamination. In another embodiment, cold sterile gaseous nitrogen is used in place of LN2.

The dimensions of the freezing chamber are such that a sufficient amount of time is allowed for the product to be in contact with the freezing agent to allow freezing of the product before it reaches the bottom of the chamber. The spray-frozen liquid product collects at the bottom of the freeze drying vessel 210 as a frozen powder, while the gaseous freezing agent is vented from the vessel. Baffles may be used in the freeze drying vessel to allow the particles to settle to the bottom without becoming entrained in the vented gas. The spray freezing process produces small particles of product that are quickly frozen because the smaller particles have much larger surface area to mass ratio and therefore a minimal resistance to heat input. That property also speeds the drying process.

The freeze drying vessel 210 may be pre-cooled to prevent frozen particulates from thawing upon contact with vessel walls or ancillary parts. The freeze drying vessel 210 may also be cooled during the spraying and subsequent steps to maintain the powder frozen as additional product is sprayed and frozen in the vessel. The vessel may be cooled, at least in part, by passing a cooled heat exchange fluid 219 such as oil through heat exchangers 230 positioned to heat or cool the drying vessel 210. The heat exchange fluid is cooled in the heat exchanger 218 by cold N2 exhaust from the condenser 216. The vessel may furthermore have a conical lower section to facilitate handling of the product. The freezing step is complete when a sufficient quantity of liquid product is spray-frozen and has been collected in the lower part of the vessel 210. A vacuum is then pulled on the freeze drying vessel 210. A vacuum pump 260 may be in communication with a condenser 250 that, in turn, may be connected to the freeze drying vessel 210 by opening a valve 256. In that case, the freeze drying vessel 210 is subjected to vacuum pressure by operating the vacuum pump 260 and opening the valve 256 between the condenser 250 and the freeze drying vessel 210.

After the chamber is evacuated, heat is introduced into the vessel walls. The same heat exchangers 230 or different heat exchangers may be positioned at the lower part of the vessel for applying heat through the vessel walls to the frozen powder. In the embodiment shown, the heat transfer fluid 219 passing through the heat exchangers 230 is heated by an oil heater 271. Alternately, the vessel may be directly heated using electrical resistance or other techniques.

To move the particles of the frozen product to the drum walls for heating, while preventing product agglomeration from occurring, the frozen powder is agitated. In one embodiment, a slow speed stirring mechanism includes an agitator 235 in the lower part of the vessel. The slow speed stirring mechanism further includes a motor 236 and a drive shaft 237. The drive shaft passes through a sealed aperture in the vessel 210, permitting the motor to be installed on the outside of the vessel, maintaining the aseptic environment within. In another embodiment, the stirring mechanism is magnetically coupled to an external drive motor, avoiding the use of seals.

Alternatively, a vibration mechanism 339 (FIG. 3) externally mounted to the wall of the vessel 300 induces vibrations in the wall of the vessel, causing the frozen powder to circulate toward and away from the vessel wall. The vibration mechanism may, for example, be a pneumatic piston impact vibrator or may be an offset mass driven by an electric motor. The vibration may alternatively be mounted on a supporting leg (not shown) of the freeze drying vessel. In another embodiment, the vessel is tumbled, inducing the powder to circulate.

Returning to FIG. 2, as frozen liquid in the product sublimates, vapor is carried through the valve 256 into the condensing vessel 250. Cooled condensing surfaces 257 in the condensing vessel collect the condensed vapor. In the case of water vapor, the vapor condenses as ice. The condensed ice must be periodically removed from the condensing vessel.

After completion of the drying step, the freeze drying vessel 210 is returned to atmospheric pressure and a valve 245 at the bottom of the drying chamber opens to allow the dried product to move through a collection valve or plate to a removable collection canister 240. Unlike a traditional tray freeze dryer system, handling of the freeze dried product is minimized, and transfer from the vessel to the collection canister may take place in a controlled, aseptic environment.

The freeze drying system 200 provides a bulk freeze dryer having a larger throughput and easier product collection than previous freeze drying solutions such as tray dryers. The technique permits the spray-freezing of product in a sterile freeze drying operation. No known prior sterile freeze drying methods utilize spray freezing.

Figure 3:
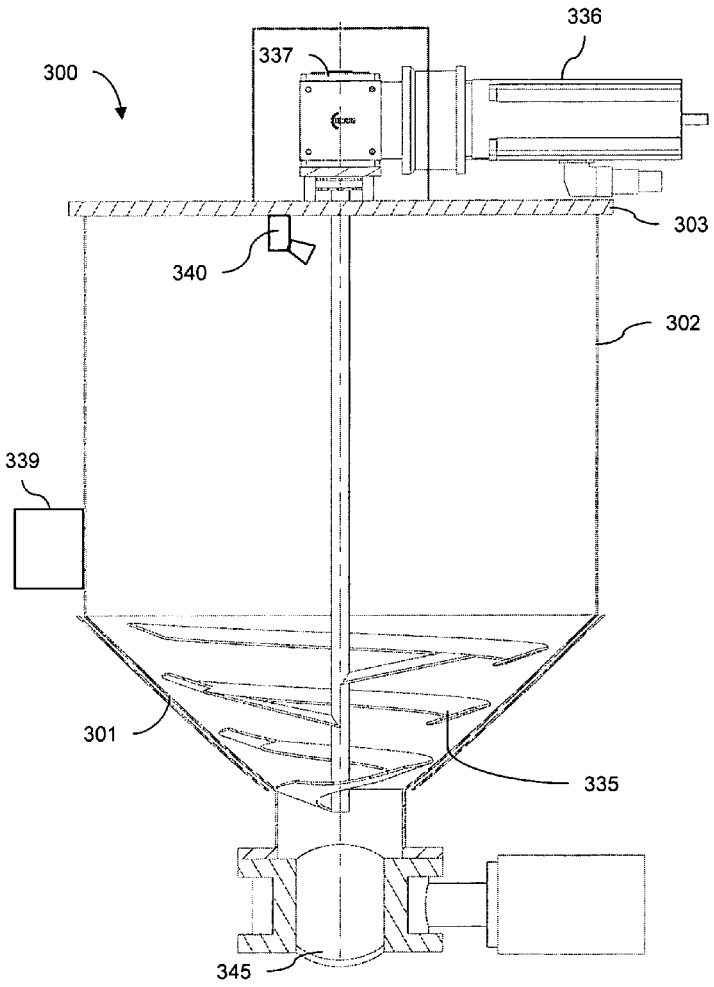
FIG. 3 is a cut-away view of a freeze dryer according to one embodiment of the disclosure.

A freeze drying vessel 300, shown in FIG. 3, includes several exemplary features discussed above. The vessel includes an upper vessel wall 302 having a cylindrical shape and a lower vessel wall 301 having, in the embodiment shown, a conical shape. A top plate 303 is sealed to the upper vessel wall and is removed only for assembly and repair procedures, and not during normal processing or maintenance.

In the embodiment wherein the product is agitated by stirring, the top plate 303 may support a motor 336 and drive train 337 for driving an agitator comprising a spiral blade 335. The blade 335 is shaped to move product that is proximate both the upper vessel wall 302 and the lower vessel wall 301. The blade rotates in close proximity with the walls, minimizing dead space between the blade and the walls. The agitator is supported from above, obviating the need for a bearing assembly at the bottom of the vessel where the freeze dried product is discharged at the end of a cycle.

A rotational washing nozzle 340 directs a liquid sanitizer on the inside vessel walls and top plate as the nozzle rotates. The complete assembly may be sterilized via steam, vaporized hydrogen peroxide (VHP), or another sterilant. Because all components that contact the product are enclosed within the freeze drying vessel, and the vessel need not be opened after each cycle, sterilization may not be necessary after each cycle.

Also mounted to the top plate 303 are nozzles 212 (FIG. 2) for spraying the liquid product and nozzles 214 for spraying the sterile freezing agent. The nozzles 212, 214 may be mounted flush with, or slightly recessed in, the inner surface of the top plate 303, to clear a top portion of the spiral blade 335 when that blade is rotating. Alternatively, nozzles 212, 214 may extend into the interior of the vessel 300, and the spiral blade 335 may be configured to provide clearance for the nozzles. In yet another embodiment, the spray freezing process takes place in a separate vessel, and the frozen powder is transferred to the vessel 300.

A discharge plate or valve 345 at the lower end of the vessel is opened after each cycle to discharge the freeze dried product. When closed, the discharge plate or valve is in close proximity with the rotational path of the spiral blade 335 to eliminate any dead space that would otherwise be created. Similarly, an inspection door (not shown) may be provided in an opening of the upper vessel wall 302 and may be configured to provide an inner surface that is flush with the inner surface of the upper vessel wall, also reducing dead space.

Figure 4:
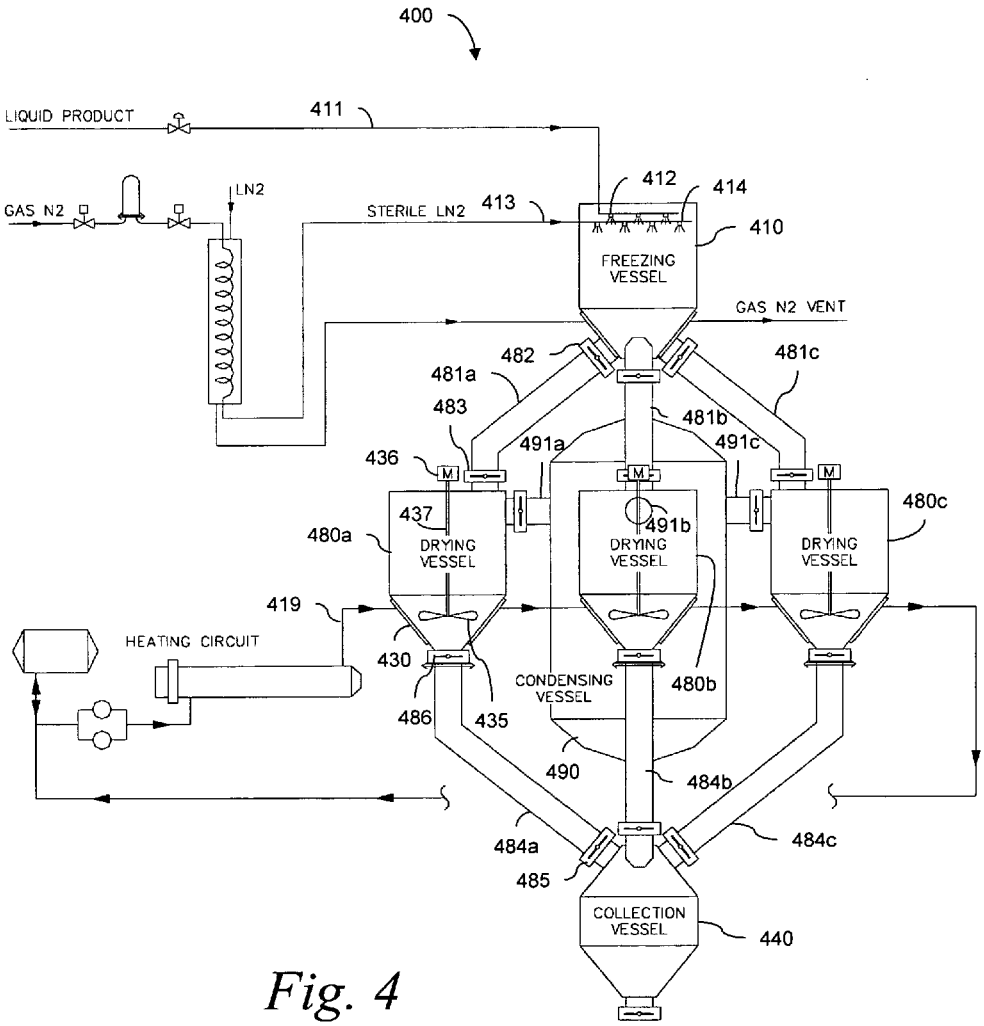
FIG. 4 is a schematic drawing of a freeze drying system according to one embodiment of the disclosure.

Another embodiment 400 of the disclosed freeze dryer, shown in FIG. 4, includes a separate freezing vessel 410 that feeds several drying vessels 480*a*, 480*b*, 480*c* arranged in parallel. The freezing vessel 410 operates in a manner similar to that described above with reference to FIG. 2. Spray nozzles 412 are connected to a source 411 of liquid product. The nozzles 412 are arranged to atomize the product within the freezing vessel 410. Another set of spray nozzles 414 is arranged to comingle a spray of an aseptic freezing agent such as sterile LN2 with the atomized liquid product. Liquid in the atomized product freezes as the sterile LN2 vaporizes and absorbs heat from the product, before the product reaches the floor of the freeze drying vessel 410. The spray nozzles 412 are connected to a source 413 of the aseptic freezing agent.

Each drying vessel 480*a*, 480*b*, 480*c* is selectively interconnected with the freezing vessel 410 by respective passageways 481*a*, 481*b*, 481*c*. The drying vessels may be selected for receiving frozen product from the freezing vessel 410 by opening valves at each end of the corresponding passageways. For example, drying vessel 480*a* is selected by opening the valves 482, 483 at each end of the passageway 481*a*. Valves in the remaining passageways 481*b*, 481*c* remain closed as the drying vessel 480*a* receives product from the freezing vessel 410. The other drying vessels 480*b*, 480*c* are selected to receive product in a manner similar to that described for drying vessel 480*a*.

The drying vessels 480*a*, 480*b*, 480*c* function as described above with reference to FIG. 2. For example, regarding drying vessel 480*a*, one or more heating jackets 430 are positioned at the lower part of the vessel for applying heat through the vessel walls to the frozen powder. A heat transfer fluid 419 is pumped through the heating jackets 430 to provide heat energy. A slow speed stirring mechanism including an agitator 435 in the lower part of the vessel moves particles of the frozen product to the drum walls for heating, while preventing product agglomeration from occurring. The slow speed stirring mechanism further includes a motor 436 and a drive shaft 437.

Upon completion of the drying cycle, the product may be released through passageways 484*a*, 484*b*, 484*c* to a common collection vessel 440. Each passageway has valves 485, 486 at the ends for selectively connecting the collection vessel 440 with a particular drying vessel. Alternatively, each drying vessel 480*a*, 480*b*, 480*c* may have a dedicated collection vessel (not shown).

Because drying is a more time consuming step than freezing, individual batches being processed by the freeze drying system 400 would be in different stages of drying. For example, as a batch of frozen product is being transferred from the freezing vessel 410 to the drying vessel 480*a*, another batch of product that had earlier been transferred to drying vessel 480*b* might be undergoing heating/sublimation in the drying vessel, while yet another batch that had been transferred even earlier to drying vessel 480*c* might have completed drying and repressurization, and be in the process of transfer to the collection vessel 440. In that way, the freezing vessel output is processed in staggered batches, allowing full utilization of both the freezing vessel and the drying vessel.

One or more condensing vessels 490 are in communication with the drying vessels through conduits 491*a*, 491*b*, 491*c*. A vacuum pump (not shown) is connected to the condensing vessel and maintains the freeze drying system at vacuum pressure during processing. In a preferred embodiment of the disclosed system, at least two parallel condensing vessels 490 are used in the system, with each drying vessel 480*a*, 480*b*, 480*c* being alternatively connectable to more than one condensing vessel. That arrangement permits a condensing vessel to be taken off line for defrosting while continuing to direct effluent from the drying vessels to an alternate condensing vessel.

The freeze drying system 400 permits the freeze drying process to run semi-continuously, with the spray freezing process operating continuously and the drying process being divided into parallel vessels that process successive, staggered batches, resulting in continuously filling the collection vessel. Condensing vessels may be taken off line and defrosted without interrupting the continuous process.

Figure 5:
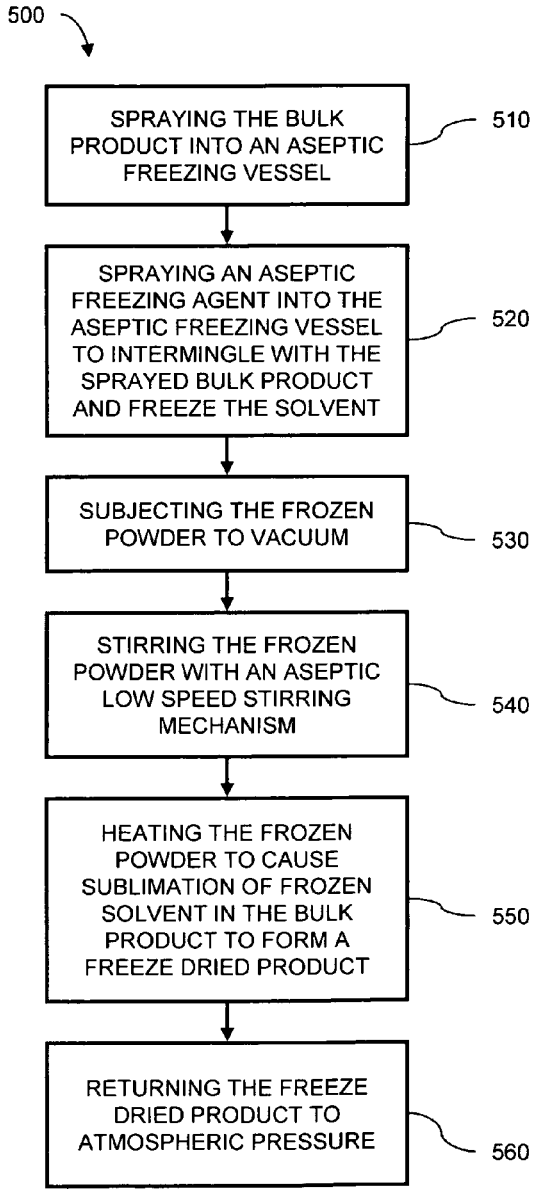
FIG. 5 is a flow chart showing a method in accordance with one aspect of the disclosure.

Also presently disclosed and shown schematically in FIG. 5 is a unique freeze drying method 500 for use in drying a bulk product containing a liquid solvent, under aseptic conditions. The liquid solvent may be water, alcohol or another solvent. The bulk product is sprayed, in step 510, into an aseptic freezing vessel. Concurrently, an aseptic freezing agent, such as sterile LN2, is sprayed, in step 520, into the aseptic freezing vessel and intermingled with the sprayed bulk product. The liquid freezing agent quickly evaporates, absorbing heat from the sprayed bulk product and causing the solvent in the bulk product to freeze. A frozen powder is formed before the bulk product reaches a lower portion of the freeze drying vessel.

The frozen powder may be transferred to a separate drying vessel for performing the subsequent steps, or may remain in the freezing vessel. In either case, the frozen powder is subjected, in step 530, to vacuum, and is agitated, in step 540, with an aseptic low speed stirring mechanism, a vibrator or another agitation mechanism. At the same time, the frozen powder is heated slightly, in step 550, to cause sublimation of the frozen solvent in the bulk product to form a freeze dried product. The heat may be transferred to the frozen powder from the walls of the vessel.

Vapor from the sublimation of the solvent from the product may be collected by condensing the vapor on a cooled surface in a condensation vessel. The condensed solvent must be removed periodically from the cooled surface. In the case where water is used as the solvent, solid ice is collected in the condensation vessel, which must be periodically defrosted.

The freeze dried product is then returned, in step 560, to atmospheric pressure and transferred to a canister.

In the case where the frozen powder is transferred to a separate drying vessel, several drying vessels may be use to service a single freezing vessel, thereby creating a semi-continuous process. A batch portion of frozen powder is produced and transferred from the aseptic freezing vessel to a first aseptic drying vessel, and, in the first aseptic drying vessel, the frozen powder is subjected to vacuum, stirred and heated. A second batch of the frozen powder is produced and transferred from the aseptic freezing vessel to a second aseptic drying vessel, and, in the second aseptic drying vessel, is subjected to vacuum, stirred and heated. The processing in the first and second drying vessels is staggered to sequentially draw from the freezing vessel. A sufficient number of additional drying vessels may be used to keep the freezing vessel operating continuously.

The foregoing Detailed Description is to be understood as being in every respect illustrative and exemplary, but not restrictive, and the scope of the invention disclosed herein is not to be determined from the Description of the Invention, but rather from the Claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention.

What is claimed is:

1. A freeze drying system for freeze drying bulk product by removing a liquid, comprising:

a freeze drying chamber for containing product during the freeze drying process;

at least one bulk product spray nozzle connected to a source of the bulk product, the at least one bulk product spray nozzle being directed to an interior of the freeze drying chamber for spraying the bulk product into the freeze drying chamber;

at least one freezing agent spray nozzle connected to a source of a freezing agent, the at least one freezing agent spray nozzle being directed to the interior of the freeze drying chamber for spraying the freezing agent into the freeze drying chamber, the at least one bulk product spray nozzle and the at least one freezing agent spray nozzle being further directed to comingle respective sprays in the interior of the freeze drying chamber to create a spray-frozen product;

a mechanical agitating mechanism in a lower portion of the freeze drying chamber for agitating spray-frozen product accumulated in the lower portion of the chamber to move particles of the product into contact with walls of the freeze drying chamber;

a heater for heating at least lower walls of the freeze drying chamber;

a condensing chamber in communication with the freeze drying chamber and comprising surfaces for condensing a vapor from exhaust gas received from the freezer drying chamber;

a vacuum pump in communication with the condensing chamber; and a controller comprising memory storing a program that, when executed by the controller, causes the freeze drying system to perform:

an aseptic spray freezing cycle wherein bulk product is sprayed from the at least one bulk product nozzle in the freeze drying chamber and a freezing agent is sprayed from the at least one freezing agent spray nozzle in the freeze drying chamber, to produce a spray frozen powder in the freeze drying chamber; and an aseptic vacuum freeze drying cycle wherein the vacuum pump evacuates the condensing chamber and the freeze drying chamber, the heater heats the lower walls of the freeze drying chamber and the rotary mechanical agitating mechanism is rotated to dry the spray frozen powder.

2. The system of claim 1, further comprising:

a sterilant introducing means for introducing a sterilant into the freeze drying chamber.

3. The system of claim 2, wherein the sterilant is selected from the group consisting of steam and vaporized hydrogen peroxide.

4. The system of claim 1, wherein the agitating mechanism comprises a rotationally driven agitator.

5. The system of claim 1, wherein the rotationally driven agitator is driven by a drive shaft passing through the chamber wall.

6. The system of claim 1, wherein the rotationally driven agitator is driven magnetically from outside the chamber wall.

7. The system of claim 1, wherein the agitating mechanism is a vibrating mechanism externally mounted to the chamber wall.

8. The system of claim 1, wherein the agitating mechanism is a vibrating mechanism mounted to a supporting leg of the freeze drying chamber.

9. The system of claim 1, wherein the freezing agent is sterile liquid nitrogen.

10. The system of claim 1, wherein a lower portion of the freeze drying chamber is conical in shape.

11. The system of claim 1, wherein the heater is an electrical heater.

12. The system of claim 1, wherein the heater is a jacket for circulating a heated fluid.

13. The system of claim 1, further comprising a jacket attached to the freezer drying chamber for circulating a cooled fluid for cooling the chamber during spraying; and a heat exchanger for cooling the cooled fluid using gas vented from the source of the freezing agent.

14. A freeze drying system for freeze drying bulk product by removing a liquid, comprising:

a freezing chamber for containing product during the freezing process;

a plurality of spray nozzles configured for comingling sprays of the bulk product and a freezing agent inside the freezing chamber to produce a bulk spray-frozen product powder;

a plurality of drying chambers;

a plurality of selectively closeable conduits connecting the freezing chamber with the drying chambers, the conduits being configured to transfer the bulk spray-frozen product powder without using trays and shelves;

each drying chamber comprising:

an agitating mechanism in a lower portion of the drying chamber for agitating spray frozen product powder in the lower portion of the chamber; and a heater for heating at least lower walls of the drying chamber;

at least one condensing chamber, each one of the plurality of drying chambers being in communication with at least one of the condensing chambers, the condensing chambers comprising surfaces for condensing a vapor from exhaust gas received from the drying chambers; and a vacuum pump in selective communication with the drying chambers and the condensing chamber.

15. The system of claim 14, further comprising:

control means for operating the selectively closeable conduits to direct the spray-frozen product powder into a first chamber of the plurality of drying chambers while simultaneously operating a second chamber of the drying chambers by evacuating the second chamber with the vacuum pump and heating the lower walls of the second chamber with the heater.

16. The system of claim 14, wherein a first drying chamber is in selective communication with first and second condensing chambers, whereby one of the first and second condensing chambers is operated to condense the solvent vapor while condensed solvent is removed from another of the chambers.

17. The system of claim 14, further comprising:

a sterilant introducing means for introducing a sterilant into at least the freezing chamber and the drying chambers.

18. The system of claim 17, wherein the sterilant is selected from the group consisting of steam and vaporized hydrogen peroxide.

19. The system of claim 14, wherein the freezing agent is sterile liquid nitrogen.

20. The system of claim 14, wherein lower portions of the drying chambers are conical.

21. A method for freeze drying a bulk product containing a liquid, comprising:

spraying the bulk product into a freezing vessel;

spraying a freezing agent into the freezing vessel, the freezing vessel being at a first pressure; the freezing agent intermingling with the sprayed bulk product to freeze the liquid contained in the bulk product to form a frozen powder before the product drops to a lower portion of the freezing vessel;

without transferring the frozen powder, subjecting the freezing vessel to a vacuum pressure lower than the first pressure;

agitating the frozen powder under vacuum using the mechanical agitating mechanism;

after subjecting the freezing vessel to the vacuum pressure, heating the frozen powder to cause sublimation of frozen liquid in the bulk product to form a freeze dried product; and returning the freeze dried product to atmospheric pressure.

22. The method of claim 21, wherein agitating the frozen powder under vacuum and heating the frozen powder are performed in the freezing vessel.

23. The method of claim 21, wherein the freezing agent is sterile liquid nitrogen.

24. The method of claim 21, wherein the bulk product and the freezing agent are sprayed from separate nozzles into the freezing vessel.

25. The method of claim 21, wherein spraying the bulk product and spraying the freezing agent are performed concurrently.

26. The method of claim 21, wherein heating the frozen powder comprises transferring heat to the walls of a vessel using a heat transfer fluid.

27. The method of claim 26, further comprising:

removing heat from the walls of the freeze drying vessel during the spraying using a heat transfer fluid cooled using vented gas from production of the freezing agent.

28. The method of claim 21, further comprising:

condensing vapor from the sublimation of the frozen liquid in a condensing vessel.

29. The system of claim 1, wherein the at least one bulk product spray nozzle and the at least one freezing agent spray nozzle are recessed in a wall of the freeze drying chamber to clear the mechanical agitating mechanism.

30. The system of claim 1, wherein the mechanical agitating mechanism is configured to provide a clearance for the at least one bulk product spray nozzle and the at least one freezing agent spray nozzle.

* * * * *